US005139164A

United States Patent [19]

Stewart

[11] Patent Number: 5,139,164

[45] Date of Patent: Aug. 18, 1992

[54] OVAL CONTAINER WITH INTERLOCKING NIBS

[75] Inventor: Donald T. Stewart, Southern Pines, N.C.

[73] Assignee: Chesebrough-Pond's USA Co., Division of Conopco, Inc., Greenwich, Conn.

[21] Appl. No.: 792,116

[22] Filed: Nov. 14, 1991

[51] Int. Cl.[5] ..... B65D 41/16

[52] U.S. Cl. ..... 220/306; 215/321

[58] Field of Search ..... 220/294, 306, 324; 215/321

[56] References Cited

U.S. PATENT DOCUMENTS

| | | | |
|---|---|---|---|
| 2,718,980 | 9/1955 | Strom . | |
| 3,032,927 | 5/1962 | Kobs | 220/306 X |
| 3,244,272 | 4/1966 | Beaman et al. . | |
| 3,351,227 | 11/1967 | Collie | 220/306 |
| 3,421,654 | 1/1969 | Hexel | 220/306 |
| 3,872,996 | 3/1975 | Dogliotti | 220/254 |
| 4,051,974 | 10/1977 | Gentile | 215/329 |
| 4,098,421 | 5/1978 | Foster . | |
| 4,117,946 | 10/1978 | Kassler | 215/321 |
| 4,245,754 | 1/1981 | Ellis | 220/304 |

*Primary Examiner*—Stephen Marcus
*Assistant Examiner*—Nova Stucker
*Attorney, Agent, or Firm*—Milton L. Honig

[57] ABSTRACT

An oval dispensing package is provided with an oval container body and cap. Two sets of wedge-shaped nibs are formed on a wall near an open end of the container body and of the cap. Each of the two sets have a pair of individual nibs with one nib on either side of a major elliptical axis defining the oval and positioned near the terminii thereof.

4 Claims, 1 Drawing Sheet

OVAL CONTAINER WITH INTERLOCKING NIBS

BACKGROUND OF THE INVENTION

1. Field of the Invention

The invention concerns an oval package, especially for cosmetic sticks, with an improved mechanism for retaining a cap onto a container body of the package.

2. The Related Art

Current packages for cosmetic sticks and the like normally utilize friction or screw threads to affix a cap to a container body. Unfortunately, friction does not hold well. A screw thread is more secure but requires more effort to detach the cap. Accordingly, there is much interest in developing a cap retention mechanism which enjoys the ease of removal characteristic of friction, yet maintains a reasonable retention security characteristic of screw threads.

The art has described a number of improvements in this area. For instance, U.S. Pat. No. 2,718,980 (Strom) discloses a capsule-shaped container having a cover and a body portion. The cover portion is provided with a bead and a groove which engage corresponding groove and bead structures on the body portion.

U.S. Pat. No. 3,244,272 (Beaman et al.) reports a coin tube having a cap and a body portion wherein four lugs on the cap snap fit into four grooves of the body of the coin tube.

U.S. Pat. No. 4,098,421 (Forster) describes a closure for a container having a cover and a body portion which snap together resiliently to close the container. Ribs formed on the body project outwardly while ribs formed on the cap project inwardly. These ribs resiliently snap past one another and then engage on an underside with a detent action to hold the cover onto the body.

None of the aforementioned mechanisms have found particular use with oval-shaped packages. These oval packages present a special difficulty in providing a proper snap-fit.

A problem especially associated with cosmetic sticks of the antiperspirant and deodorant variety is that of crystallization induced by pressure from the package. Cosmetic stick compositions such as deodorants and antiperspirant are often poured hot into the container which is then capped. Upon cooling the container shrinks along with the product. Pressure from the cap retention structures then provide points of crystallization for the cooling stick. Crystallization is quite undesirable. Thus, it is important to avoid retention structures which apply pressure against the container body which may be transmitted to the stick composition.

Accordingly, it is an object of the present invention to provide an oval package with an improved retention mechanism between cap and body.

Another object of the present invention is to provide an oval package with a retention mechanism that achieves a positive hold between cap and container but nevertheless, is easily separable through a snap action.

A still further object of the present invention is to provide an oval package for a cosmetic stick which overcomes the problems of stick crystallization caused by cap stress on the package.

These and other objects of the present invention will become more evident through the following summary, examples and detailed description.

SUMMARY OF THE INVENTION

An oval dispensing package is provided which consists of a container body and a cap. The container body has an open and a closed end. In cross section, the body has an oval shape defined by a major and a minor elliptical axis. The major axis intercepts opposite terminii of the oval body at the open end thereof. The body has an outer wall on which is formed two sets of retention structures. Each set has a pair of projections with each one of the pair symmetrically juxtaposed on either side of the major axis near one of the terminii of the oval body open end.

The cap portion of the dispensing package also has an open and a closed end. The cap formfittingly engages with its open end over the open end of the container body. On an inner surface of the cap there projects a plurality of retention structures cooperatively engageable with the retention structures of the container body.

Advantageously, the retention structures are each in the form of a wedge having a narrow and a wider end aligned parallel to a longitudinal axis traversing the dispenser from top to bottom. The narrow end of each wedge is pointed toward the respective opening of the container body and cap. Packages of the present invention are particularly suitable for housing antiperspirant and deodorant stick compositions.

BRIEF DESCRIPTION OF THE DRAWING

The above objects, advantages and features of the present invention will now be described by way of a nonlimiting embodiment and reference to the accompanying drawing in which.

DETAILED DESCRIPTION

Figure 1:
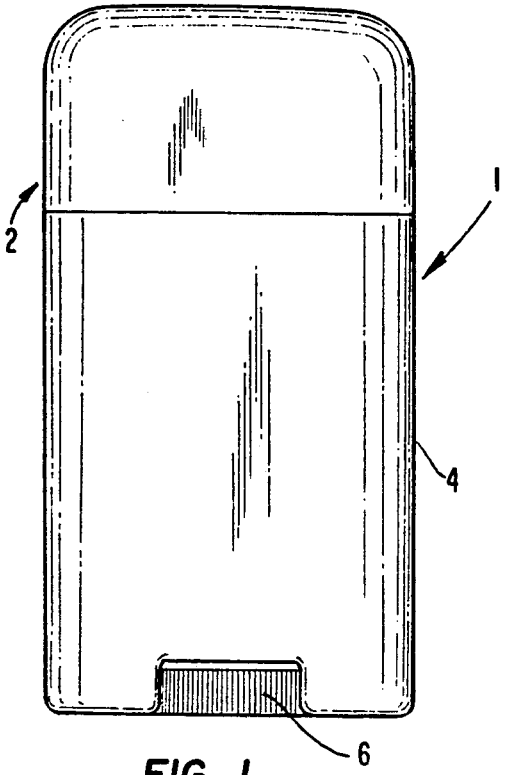
FIG. 1 is a front plan view of the dispensing package.

FIG. 1 illustrates an oval dispensing package 1 which consists of a cap 2 and a container body 4. Within the container body is a propel-repel device consisting of a knurled knob 6 at a bottom closed end of the container body 4 rotatably operating a threaded post 8. A cosmetic stick 10 is supported on post 8. Knurled knob 6, when rotated, operates post 8 to raise or lower the cosmetic stick 10 above or below an upper edge 12 of a mouth of the container body at an open end thereof. Container body 4 is defined by a wall having an upper and a lower wall portion 16 and 20, respectively. The upper wall portion 16 is slightly recessed with ledge 18 separating the upper and the lower portion.

Figure 2:
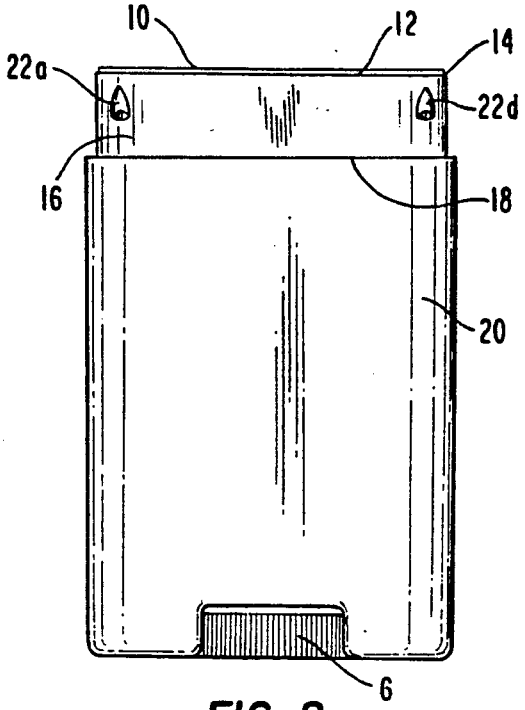
FIG. 2 is a front plan view of the uncapped dispensing package.
Figure 3:
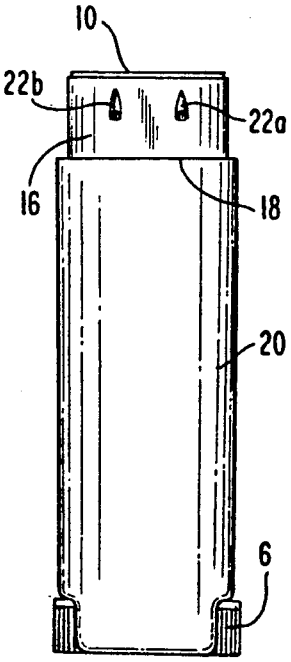
FIG. 3 is a side view of the uncapped dispensing package shown in FIG. 2.
Figure 4:
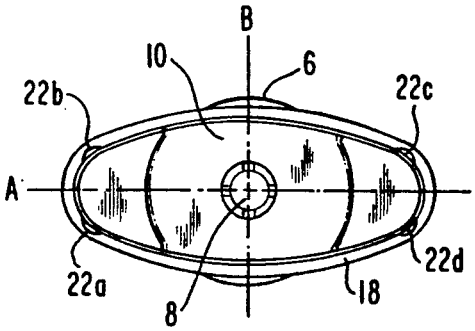
FIG. 4 is a top view of FIG. 2.

Along upper wall portion 16 are positioned two pair of retention structures formed as outwardly projecting nibs *22a–22d*. See FIGS. 2 through 4. These nibs are symmetrically but non-equidistantly placed in a coplanar manner along wall portion 16. On the other hand, each pair of nibs *22a–22b* and *22c–22d* is equidistantly displaced from the other pair. Within the pair the two nibs, for instance *22a* and *22b*, symmetrically straddle the major elliptical axis A near a terminii of the oval upper wall portion 16. More precisely, there is a single nib in each quadrant of a cross sectional plane through the oval container body, each nib being closer to the major axis A than the minor axis B. Indeed, the distance between nibs 22*a* and 22*d* from each of the pairs is at least twice as circumferentially long, optimally about four times as long as the distance between nibs 22*a* and 22*b* forming each nib pair. These relationships are outlined in FIG. 4.

Figure 5:
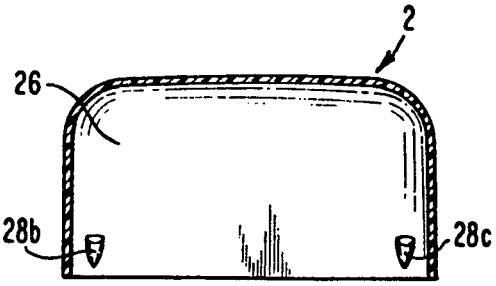
FIG. 5 is a cross sectional view of the cap taken along line 5—5 of the dispensing package shown in FIG. 1.

FIG. 5 is a cross sectional view of cap 2 focusing upon an inner wall 26 thereof. Four nibs 28*a–d* (with only 28*b* and 28*c* shown) are formed along the inner wall 26. These nibs 28*a–d* are positioned to lie directly above and interlock with nibs 22*a–*22*d* when cap 2 is snap fitted onto container body 4. Along a lower edge at an open end of inner wall 26 there is fashioned a circumferential bevel 30 which assists in initially engaging the nibs 22*a–*22*d* of the container body.

Figure 6:
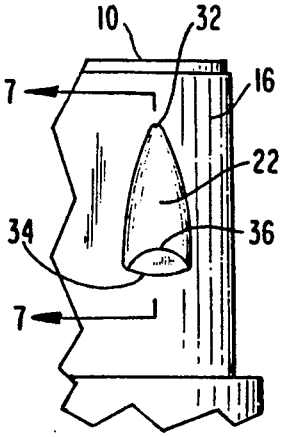
FIG. 6 is an expanded front view of one of the retention structures or nibs illustrated in FIGS. 2–5.

FIG. 6 provides an expanded view of nib 22 which can be identical to nib 28. The nib is a wedge-shaped projection unitarily formed within the outer wall portion 16 of the container body or inner wall 26 of the cap. Each nib is oriented in a vertical direction parallel to a longitudinal axis of the dispensing package 1. The wedge is triangular in nature with one end 32 tapering to a narrow point and opposite thereto a butt end 34 fanning outward and downward. A change in slope of the nib occurs at a ridge 36 distant no greater than 30% from the fanned butt end 34 relative to the tapered point end 32.

Figure 7:
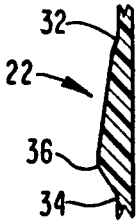
FIG. 7 is a cross sectional view of the retention structure or nib taken along line 7—7 of FIG. 6.

FIG. 7 provides a cross sectional view through nib 22. This figure emphasizes the change in slope at ridge 36.

Nibs 22*a–*22*d* have their tapered point ends 32 directed upwards toward the open mouth 12 of the container body. Likewise, nibs 28*a–*28*d* have their tapered point ends pointing downward also in a direction toward the open end of cap 2.

When cap 2 is pushed onto container body 4, nibs 22*a–d* frictionally slide past respective nibs 28*a–d* until the butt ends 34 back onto one another thereby interlocking the arrangement.

A variety of cosmetic compositions may be utilized with the dispensing package of the present invention. In particular, these may be antiperspirant or deodorant cosmetic sticks of a transparent or opaque variety. Typically these sticks may contain one or more of the following ingredients: anywhere from 1 to 90% of a polyhydric alcohol, from 1 to 40% of a soap, from 1 to 40% of an alkoxylate, from 1 to 40% of a fatty alcohol, from 1 to 90% of water, from 1 to 40% of a silicone and effective amounts of an active ingredient such as an antimicrobial or an astringent salt, for instance, triclosan or an aluminum compound, respectively.

EXAMPLE 1

A study was performed on the effect of cap retention structures on crystal formation of a typical commercial clear deodorant stick. The cosmetic formula utilized in the dispensing packages was as follows:

| Ingredient | Wt. % |
|---|---|
| Propylene glycol | 60.0 |
| Deionized water | 27.05 |
| Sodium stearate | 7.5 |
| Lauramide DEA | 4.0 |
| Triclosan | 0.3 |
| Colorant | 0.15 |

-continued

| Ingredient | Wt. % |
|---|---|
| Fragrance | 0.8 |

Several hundred sticks with the above formula were prepared by pouring a molten amount into a like number of dispensing packages. A first series of sticks were evaluated in a regular typical commercial dispensing package having no retention structures either in the cap or along the upper wall portion of the container body. Another series of the same cosmetic sticks were evaluated in the same regular dispensing package, except that the cap on an inner surface thereof had a plurality of equispaced elongated ribs; there were no cooperative retention structures present along the upper outer wall portion of the container body. A final series of the same formula sticks were evaluated in the dispensing package according to the present invention having interlocking nibs both within the cap and on the upper wall of the container body.

Five trained analysts examined the deodorant sticks produced in each of the runs. The sticks were examined for crystallization and other defects. The following data was recorded: the number of squares covered with crystals (40 square gauge was used) and the size of crystals (a ten-point scale was used: 0=no crystals; 1 to 3=small crystals; 4 to 6=medium crystals; 7 to 9=large crystals).

Each dispensing package was formed of a polypropylene plastic.

Table I summarizes the percentage of crystal-free sticks as a function of the different package arrangements. Table II reports in greater detail on the surface crystallization. Table III provides a summary of the crystal size of the various series of packages tested.

TABLE I

Percentage of Crystal-Free Sticks

| Package Variable | % of Crystal-Free Sticks |
|---|---|
| Regular package without retention structures | 10 |
| Regular package but with long-ribbed cap | 43 |
| Snap-fit cap with interlocking nibs | 71 |

TABLE II

Surface Crystallization

| Surface Area Covered | Package Variance: Regular Package | Regular Package/ Long-Ribbed Cap | Snap Fit with Interlocking Nibs |
|---|---|---|---|
| No crystals | 30* | 43 | 71 |
| | 10.00** | 43.00 | 71.00 |
| Less than 20% | 58 | 44 | 26 |
| | 16.00 | 44.00 | 26.00 |
| Less than 40% | 110 | 13 | 3 |
| | 36.67 | 13.00 | 3.00 |
| Less than 60% | 67 | 0 | 0 |
| | 22.33 | 0.00 | 0.00 |
| Less than 80% | 34 | 0 | 0 |
| | 11.33 | 0.00 | 0.00 |
| More than 80% | 11 | 0 | 0 |
| | 3.67 | 0.00 | 0.00 |
| Total | 300 | 100 | 100 |

Note:
*frequency (number of sticks in a given category)
**percent (percent of sticks in a given category)

TABLE III

| Package Variant | Crystal Size No Crystals | Small Crystals | Medium Crystals |
|---|---|---|---|
| Regular package | 2 (1%) | 297 (99%) | 1 (1%) |
| Regular package/ Long-Ribbed Cap | 5 (5%) | 83 (83%) | 12 (12%) |
| Snap Fit with Interlocking Nibs | 11 (11%) | 83 (83%) | 6 (6%) |

From a review of Tables I–III, it is evident that the interlocking nib arrangement of the present invention is particularly beneficial with respect to avoiding crystallization of cosmetic sticks.

Although the invention has been described with reference to specific embodiments, it shall be duly understood that it is in no way limited thereto and various modifications of shape and materials may be brought thereto without departing from the scope or spirit of the invention.

What is claimed is:

1. An oval dispensing package comprising:

a container body having an open and a closed end, in cross section the body having an oval shape defined by a major and a minor elliptical axis, the major axis intercepting opposite terminii of the oval body at the open end thereof, the body having an outer wall on which is formed two sets of retention means, each set having a pair of retention members with each of the members symmetrically juxtaposed on either side of the major axis near one of the terminii of the oval body open end, at least one of the retention members being a wedge-shaped nib with one end of the nib being tapered toward a point and an opposite end thereof having a broad fan shape; and a cap having an open and a closed end, the cap formfittingly being engageable with its open end over the open end of the container body, the cap having an inner surface from which projects a plurality of retention means cooperatively engageable with the retention means of the container body.

2. A dispensing package according to claim 1 wherein the tapered end of the nib is pointed toward the open end of the oval container body.

3. A dispensing package according to claim 1 wherein each of the retention members of the two sets of retention means is a wedge-shaped nib and wherein nibs from each of the sets of nibs on the container body are at least twice as distant from one another as a distance between two nibs of the same set.

4. An oval dispensing package comprising:

a container body having an open and a closed end, in cross section the body having an oval shape defined by a major and a minor elliptical axis, the major axis intercepting opposite terminii of the oval body at the open end thereof, the body having an outer wall on which is formed two sets of retention means, each set having a pair of retention members with each of the members symmetrically juxtaposed on either side of the major axis near one of the terminii of the oval body open end, and a cap having an open and a closed end, the cap formfittingly being engageable with its open end over the open end of the container body, the cap having an inner surface from which projects a plurality of retention means that are cap retention members cooperatively engageable with the retention members of the container body, each of the retention members on the cap being identical in shape to those on the container body.

* * * * *